United States Patent [19]

Shimokawa

[11] Patent Number: 5,044,295

[45] Date of Patent: Sep. 3, 1991

[54] APPARATUS FOR REMOVING BILGE WATER OUT OF A BOAT

[76] Inventor: Toshiharu Shimokawa, 579-294 Yoshimutago, Nagayo-cho, Nishionogi-gun, Nagasaki-ken, Japan

[21] Appl. No.: 152,414

[22] Filed: Feb. 4, 1988

[30] Foreign Application Priority Data

Mar. 28, 1987 [JP] Japan ..... 62-74995

[51] Int. Cl.[5] ..... B63B 13/00

[52] U.S. Cl. ..... 114/183 A; 417/330; 185/30

[58] Field of Search ..... 114/183 R, 183 A, 184, 114/185; 185/30; 417/330–333, 338

[56] References Cited

U.S. PATENT DOCUMENTS 2,624,305 1/1953 Herrick et al. ..... 114/183 A
3,007,430 11/1961 Breneman ..... 114/183 A
3,040,671 6/1962 Whitehurst ..... 114/183 A

FOREIGN PATENT DOCUMENTS 559355 3/1957 Italy ..... 114/183 A
735822 5/1980 U.S.S.R. ..... 185/30

*Primary Examiner*—Jesus D. Sotelo
*Attorney, Agent, or Firm*—Lowe, Price, LeBlanc and Becker

[57] ABSTRACT

An apparatus for removing water out of a boat which comprises: a swingable member which is swingable according to a rolling and/or pitching motion of the boat; and water discharging pump device which is operated by the swinging motion of the swingable member caused by rocking motion of the boat such as rolling and/or pitching motion of the boat.

6 Claims, 3 Drawing Sheets

APPARATUS FOR REMOVING BILGE WATER OUT OF A BOAT

BACKGROUND OF THE INVENTION a. Field of the Invention

This invention relates to an apparatus for removing or emptying bilge water from a vessel, especially a small vessel such as a boat, and, more particularly, to an apparatus which utilizes rolling and/or pitching movement of the boat to pump out bilge water from the boat without the aid of a motor or engine.

b. Prior Art

Various pipe lines are installed in a vessel. For example, a bilge ballast piping comprises a pipe system for supplying or discharging ballast water into or from a double-bottomed ballast water tank or a bow or stern water tank and a pipe system for drawing off bilge water which has been accumulated in a bilge due to seepage or leakage from various portions of the vessel or sweating of cargo in a hold. These pipe systems are branched from a valve casing connected to a bilge pump or ballast pump in an engine room and are led to various compartments.

These pumps are in general driven by power supplied from an electric generator mounted on the vessel. These pumps, however, may possibly be inoperative due to possible malfunction of the electric generator in case of emergency. Thus, the pumps may often become useless when water discharge is most needed. Besides, small vessels such as small fishing boats, yachts, cruisers sometimes do not have water discharging equipment. In these cases, if leakage occurs, a serious accident may occur as human effort is not sufficient to discharge water.

SUMMARY OF THE INVENTION

This invention has been made to obviate the problems as described above, and it is an object of the present invention to provide an apparatus which is capable of automatically discharging water from a boat without aid of power, e.g. en electric power in such an emergency that an accident will otherwise happen.

The present invention features an apparatus for removing water out of a boat, which comprises a swingable member which is swingable according to a rolling and/or pitching motion of the boat and water discharging pump means which is operated by the swinging motion of said swingable member.

In the apparatus, the water discharging pump means comprises an inlet valve and an outlet valve which are led respectively to a pool of bilge water and outside of the boat through a suction pipe and discharge pump, respectively.

In a preferred mode, the swingable member comprises a rod member. The rod member is supported at one end portion thereof by the boat so that it may hang down vertically in its stationary position and it may be swingable according to the rolling and/or pitching motion of the boat. The rod member further comprises an actuating member which is held at a position selected along the length of the rod member. This actuating member is adapted to actuate said water discharging pump means according to the swinging motion of the boat.

In another preferred mode, the rod member of the swingable member has a weight at another end portion thereof. The actuating member comprises a push member which is projected symmetrically in a direction perpendicular to a longitudinal axis of the rod member. The water discharging pump means comprises a pair of diaphragm pumps which are actuated by the push member.

The push member is preferably fixed to a diaphragm member of each of the diaphragm pumps.

In a still another preferred embodiment, the rod member of the swingable member has a weight at another end portion thereof. The actuating member comprises a pair of rods fixed to the rod member at a position selected along the length of the rod member. The water discharging pump means comprises a pair of piston pumps each having a cylinder accommodating a piston therein. Each piston has a piston rod which is connected to the respective rod of the actuating member.

In a still further preferred embodiment, the rod member of the swingable member has a weight at another end portion thereof. The actuating member comprises a pair of rods fixed to the rod member at a position selected along the length of the rod member. The water discharging pump means comprises a pair of plunger pumps having cylinders accommodating the plungers therein, respectively. Each the plunger is connected to the respective rod of the actuating member.

In a still further preferred embodiment, the actuating member comprises a horizontal rod or bar member which is fixed, at its substantially central position, to said one end of the swingable member so as to be swingable conjointly with the rod member and extend substantially in a horizontal direction at its stationary position. The water discharging pump means is disposed within a swinging region of the horizontal rod or bar member and actuated by the swinging motion of the horizontal rod or bar member.

With the arrangement of the present invention as described above, the water discharging pump is driven by utilizing rocking motion of a boat such as rolling and/or pitching motion of the boat. More particularly, the boat at sea is always subjected to the rocking motion and performs rolling and/or pitching movements about its longitudinal and/or transverse axis, respectively. These rolling and/or pitching movements may be utilized for driving the pump and discharging water, for example, bilge water out of the boat.

Especially in case of emergency due to stormy weather, the boat is subjected to violent rolling and/or pitching movements, which will increase the driving power for discharging water. In general, water discharging is especially needed in the emergency case and desirable pumping operation for discharging water can advantageously be obtained in such an emergency case by the amplified rolling and/or pitching due to the rough weather.

DESCRIPTION OF EMBODIMENTS

The invention will now be described in detail referring to embodiments shown in the attached drawings.

Configuration of First Embodiment

Figure 1:
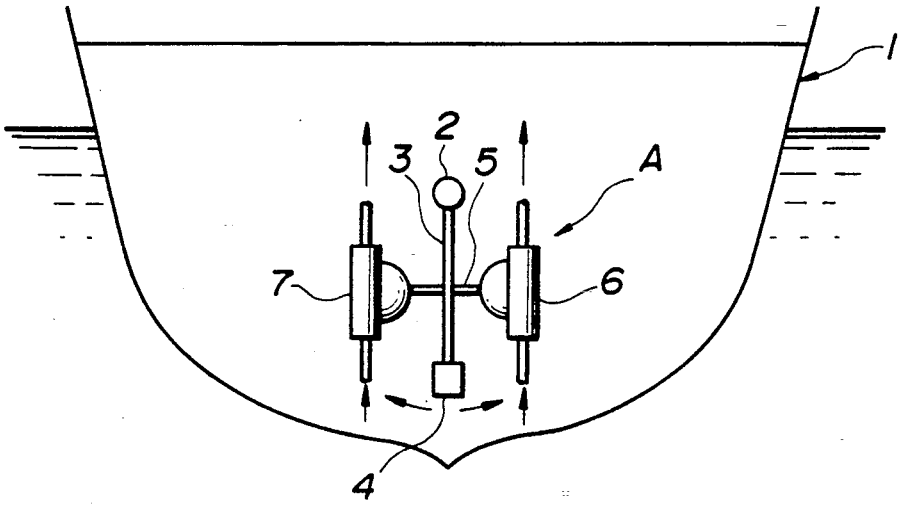
FIG. 1 is an explanatory view showing a general configuration of one embodiment of the present invention.
Figure 2:
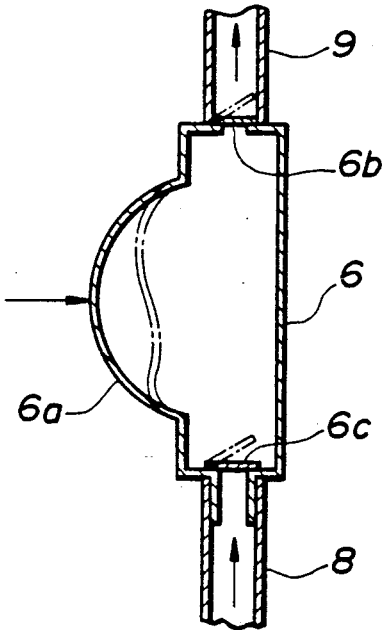
FIG. 2 is an explanatory view showing a water discharging operation by a pump.

FIG. 1 is a schematic view of an apparatus A for removing water out of a small vessel such as a boat according to a first embodiment of the present invention. This apparatus comprises a rod member 3 which is swingably supported, at an upper end thereof, by a fulcrum 2, at some suitable point of a boat 1, for example in the vicinity of a center of buoyancy. A weight 4 is connected to a lower end of the rod member 3. A push member 5 is fixed at an intermediate portion between the ends of the rod member 3. A pair of diaphragm pumps 6, 7 are disposed on opposite sides so as to be actuated respectively by ends of the push member 5 which is swingable to and fro conjointly with the rod member 5. Thus, the push member 5 acts as an actuator for the diaphragm pumps 6, 7.

Each of the pumps 6, 7 comprises a diaphragm portion 6*a* which is adapted to be displaced and deformed by the respective tip end of the push member 5 and an inlet and an outlet valve 6*b*, 6*c*. These valves 6*b*, 6*c* are connected to a suction pipe 8 and a discharge pipe 9, respectively. The suction pipe 8 is arranged so that a tip end thereof may be placed at a hold or bilge to suck bilge water, for example, through a strainer. A tip end of the discharge pipe 9 is guided to the outside of the boat. The diaphragm portion 6*a* is made, for example, of a nitrile rubber of 0.5 mm thick and is self-restoring owing to its resiliency.

The apparatus for removing water according to the present invention is installed on the boat in such a way that the oscillation plane of the rod member 3 may be in a most likely rocking direction of the boat, generally in a rolling direction. However, for example, two water removing apparatuses may be installed in combination at right angles to each other. In this case, not only rolling but also pitching movement may be utilized for driving the pump.

Operation of First Embodiment

Now, if the boat 1 is inclined to the right by the rolling of the boat 1, the rod member 3 remains vertical due to the weight 4. Thus, it rotates counterclockwise relative to the boat 1. As a result of this, the push member 5 fixed to the rod member 3 pushes the diaphragm 6*a* to distort it. Then, the lower inlet valve 6*c* is urged to its closed position and the upper outlet valve 6*b* is opened, so that water in the pump 6 is forced out and discharged out of the boat through the discharge pipe 9.

When the boat 1 begins to incline to the left due to the rolling motion, the diaphragm 6*a* of the pump 6 is released from the pushing by the push member 5 to begin to restore its original configuration. Thus, the pressure of the inside of the pump 6 is lowered, closing the upper outlet valve 6*a* and opening the lower inlet valve 6*c*. As a result of this, water flows into the vacant space of the pump 6 through the suction pipe 8.

At the same time, the left pump 7 is driven in a similar way to force out the water within the pump 7. These operations are repeated according to the rolling motion of the boat 1 to remove or empty water in the hold or bottom of the boat.

Experiment

Figure 3A:
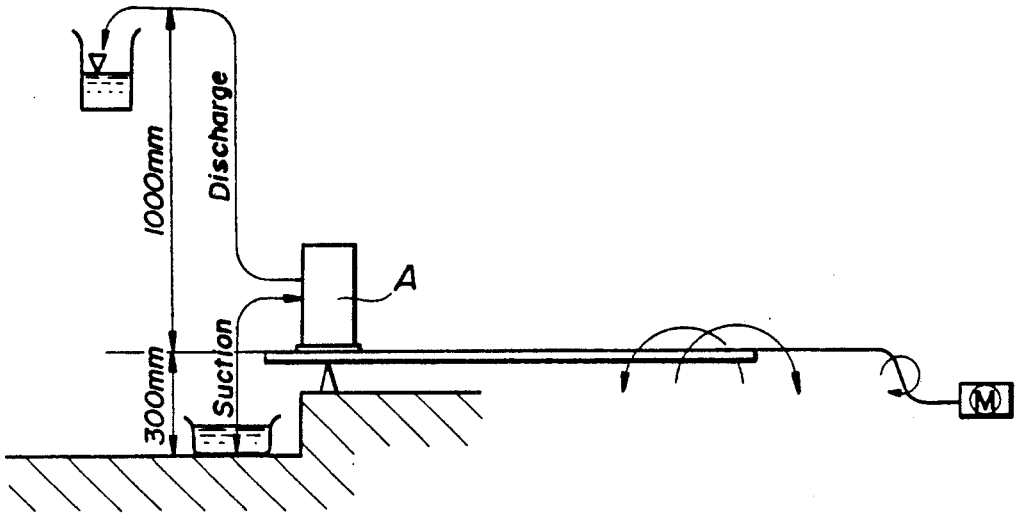
FIGS. 3A and 3B are explanatory views showing an apparatus and conditions of an experiment conducted by using the embodiment as shown in FIG. 1.
Figure 3B:
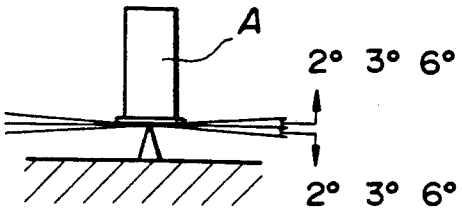

A water discharging apparatus of FIG. 1, which has a water-discharge capacity of 5 cc per one swing motion (to-and-fro rocking) by inclination of 3°, was used to conduct experiments under the setting conditions as shown in FIG. 3A and at the rocking angles of 2°, 3° and 6° as indicated in FIG. 3B to measure water amounts discharged. The rocking was caused 15 times (15 reciprocating rocking motions) per minute. The results are as shown in Table 1.

TABLE 1

| Angle | Run No. First | Run No. Second | Run No. Third | Average Amount | Total Amount (after 24 h) |
|---|---|---|---|---|---|
| 2° | 27 cc | 24 cc | 29 cc | 27 cc | 38880 cc |
| 3° | 67 cc | 76 cc | 72 cc | 72 cc | 103680 cc |
| 6° | 101 cc | 98 cc | 106 cc | 102 cc | 146880 cc |

Configuration of Second Embodiment

Figure 4:
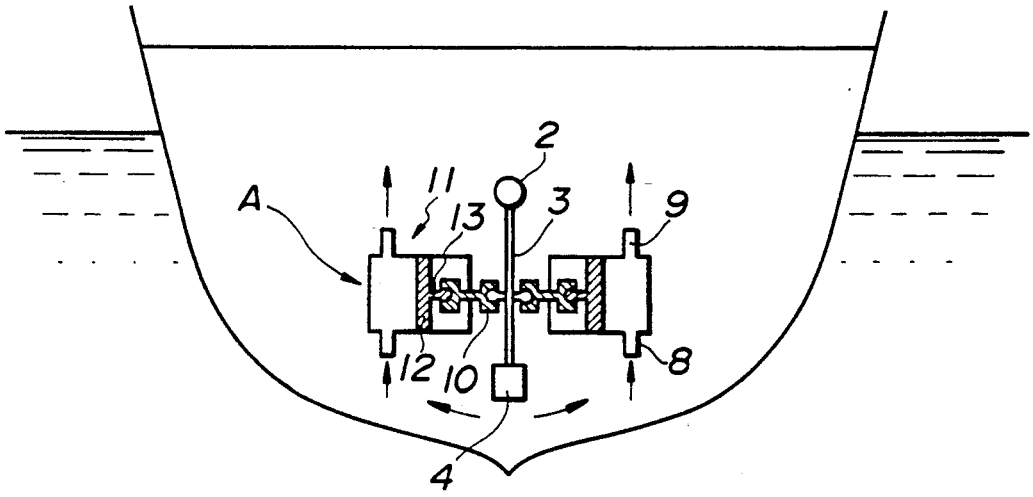
FIG. 4 is an explanatory view showing a general configuration of another embodiment of the present invention.

Second embodiment of the present invention is illustrated in FIG. 4.

In the present embodiment, an actuating member 10 is mounted at an intermediate position between the ends of the rod member 3. This actuating member 10 is formed essentially of a rod or bar member and connected to a rod 13 of a piston or plunger 12 of a piston or plunger pump 11 through a joint means such as a ball joint. The piston pump or plunger pump 11 is connected to the suction pipe 8 and the discharge pipe 9 through an inlet valve and a delivery valve (not shown), respectively.

Operation of Second Embodiment

Now, if the boat 1 inclines to the right, the rod member 3 maintains its vertical position due to the weight of the weight 4 and therefore, it rotates counter-clockwise relative to the boat 1. As a result of this, the piston or plunger 12 of the right piston pump or plunger pump 11 is pushed to force the water in the cylinder out of the pump into the discharge pipe 9.

On the other hand, the piston or plunger 12 of the left piston pump or plunger pump 11 is pulled, so that bilge water is sucked from a pool of bilge water into the cylinder through the suction pipe 8.

These operations are repeated according to the rocking of the boat and the swinging of the rod member 3, discharging bilge water out of the boat.

Configuration of Third Embodiment

Figure 5:
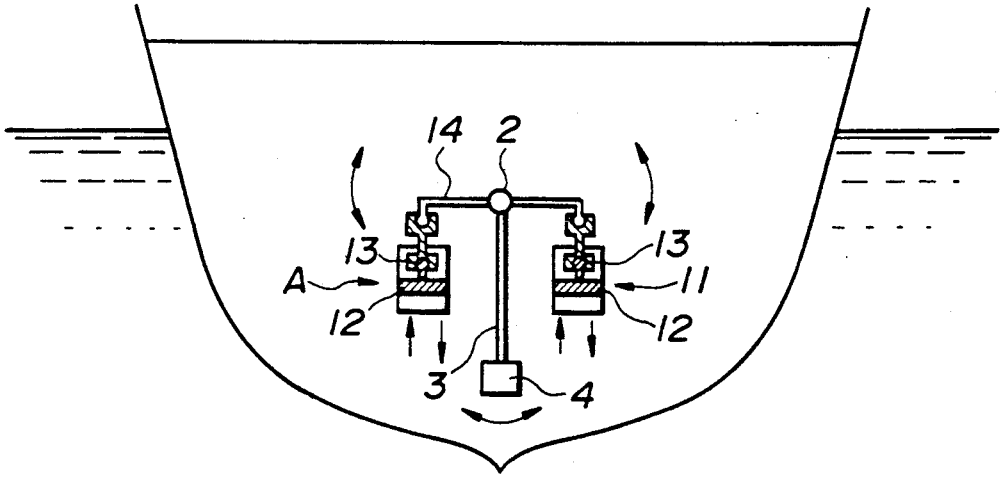
FIG. 5 is an explanatory view showing a general configuration of still another embodiment of the present invention.

A third embodiment of the present invention is illustrated in FIG. 5.

In the present embodiment, a rod or bar member 14 which extends substantially in a horizontal direction is fixed to a top end portion of the rod member 3. The rod or bar member 14 and the rod member 3 are conjointly swingable with each other around the fulcrum 2. The rod or bar member 14 constitutes an actuating member for actuating a piston or plunger pump 11, together with an actuator. This actuator is connected to each of end portions of the rod or bar member 14 and further connected to a rod 13 of a piston or plunger 12 of a piston or plunger pump 11 through a joint means such as a ball joint. The piston pump or plunger pump 11 is connected to the suction pipe and the discharge pipe through an inlet valve and an outlet valve, respectively.

Operation of Third Embodiment

Now, if the boat 1 inclines to the right, the rod member 3 maintains its vertical position due to the weight of the weight 4 and, therefore, rotates counter-clockwise relative to the boat 1. As a result of this, the piston or plunger 12 of the right piston pump or plunger pump 11 is pushed to force the water in the cylinder out of the pump into the discharge pipe 9.

On the other hand, the piston or plunger 12 of the left piston pump or plunger pump 11 is pulled, so that bilge water is sucked from a pool of bilge water into the cylinder through the suction pipe 8.

These operations are repeated according to the rocking of the boat and resultant swinging of the rod member 3 to discharge bilge water out of the boat.

Modification of Embodiment

In the foregoing embodiments, the pumps 6, 7 or 11 are driven in accordance with the swing of the rod member 3 having the weight 4 at its lower position which is caused according to the rocking motion of the boat. Alternatively, however, the lower portion of a mast may be supported swingably relative to the boat to utilize its swinging motion for driving the pump to discharge water.

Furthermore, although the diaphragm member of the diaphragm pump is adapted to restore its original configuration by its own resiliency after it has been once deformed by the push member, the tip end of the push member may be fixed to the diaphragm member to forcibly restore its original position by the swinging motion of the rod member 3. In this case, the operation of the pump can be effected more positively.

I claim:

1. Apparatus for removing water out of a boat, comprising:

a) a swingable rod mounted within the boat for swinging movement in response to at least one of rolling and pitching motion of the boat, said rod extending substantially vertically in its stationary position and being supported at one end portion thereof by the boat and having a weight at the other end portion thereof;

b) an actuating push member connected to extend generally perpendicular to the swingable rod member; and c) water discharging diaphragm pump means including a first diaphragm pump having a diaphragm defining a diaphragm pump chamber, an inlet valve connected to a suction pipe and an outlet valve connected to a discharge pipe through which inlet valve and suction pipe bilge water enters the pump chamber and through which outlet valve and discharge pipe bilge water is discharged from the pump chamber;

said actuating member contacting to act directly on and push the diaphragm to cause water to be discharged form the pump chamber in response to swinging movement of the rod in a predetermined direction.

2. The apparatus of claim 1, wherein said diaphragm is resilient to restore itself to its original configuration and thereby create suction during the restoring movement to cause bilge water to enter the chamber by suction through the suction pipe and inlet valve.

3. The apparatus of claim 1, wherein said push member has one end in contact with the diaphragm to compress the chamber in response to movement of the swingable rod.

4. The apparatus of claim 3, wherein said one end is fixed to the diaphragm to forceably compress and expand the chamber.

5. The apparatus of claim 1, wherein said weight is suspended form the lower end of the swingable rod.

6. The apparatus of claim 1, wherein said pump means includes a second diaphragm pump substantially identical to the first pump, said actuating member contacting the diaphragms of both the first and second pumps to alternately compress the chamber of one pump while the other pump chamber fills with bilge water.

* * * * *